US006498304B1

(12) United States Patent
Hedström et al.

(10) Patent No.: US 6,498,304 B1
(45) Date of Patent: Dec. 24, 2002

(54) INSULATOR FOR AN ELECTRICAL CONDUCTOR PROVIDED WITH AN OUTER SHIELD

(75) Inventors: Lars Hedström, Skellefteå (SE); Lennart Lundmark, Skellefteå (SE)

(73) Assignee: MT Memoteknik AB, Skelleftea (SE)

( * ) Notice: Subject to any disclaimer, the term of this patent is extended or adjusted under 35 U.S.C. 154(b) by 0 days.

(21) Appl. No.: 09/786,677

(22) PCT Filed: Aug. 16, 1999

(86) PCT No.: PCT/SE99/01375

§ 371 (c)(1),
(2), (4) Date: Jun. 28, 2001

(87) PCT Pub. No.: WO00/16344

PCT Pub. Date: Mar. 23, 2000

(30) Foreign Application Priority Data

Sep. 10, 1998 (SE) ..... 9803063

(51) Int. Cl.[7] ..... H01B 17/00

(52) U.S. Cl. ..... 174/149 R; 174/138 R; 174/139; 174/142; 174/145; 174/154; 174/167; 174/168; 174/176; 174/185; 174/194

(58) Field of Search ..... 174/149 R, 138 R, 174/139, 142, 145, 154, 167, 168, 176, 185, 194; 361/302

(56) References Cited

U.S. PATENT DOCUMENTS

| | | | | |
|---|---|---|---|---|
| 4,267,529 A | | 5/1981 | Brun et al. | |
| 4,399,419 A | | 8/1983 | Dobrovolny | |
| 4,453,153 A | | 6/1984 | Capek et al. | |
| 4,559,506 A | | 12/1985 | Capek | |
| 4,575,691 A | | 3/1986 | Capek et al. | |
| 4,884,982 A | * | 12/1989 | Fleming et al. | 333/185 |
| 4,945,318 A | * | 7/1990 | Kabachinski et al. | 333/12 |
| 4,952,173 A | * | 8/1990 | Peronnet et al. | 439/583 |
| 4,987,391 A | * | 1/1991 | Kusiak, Jr. | 333/12 |
| 6,054,649 A | * | 4/2000 | Uchida et al. | 174/36 |

FOREIGN PATENT DOCUMENTS

WO WO 96/35243 A1 11/1996

* cited by examiner

*Primary Examiner*—Dean A. Reichard
*Assistant Examiner*—Jinhee J Lee
(74) *Attorney, Agent, or Firm*—Banner & Witcoff, Ltd.

(57) ABSTRACT

The invention relates to an insulator for an electrical conductor provided with an outer shield, especially a so-called coaxial cable or shielded twin cable, in order to achieve an insulation at the shield that insulates against DC and low frequency AC signals transforming through the conductor and that includes a first and a second element (3,4) formed from electrically conducting material that by means of a dielectric (5) are electrically insulated and delineated from one another. and that are intended to be connected between an interruption at the shield or between the shield and an external earth connection. To achieve an insulator of the type that uses a standard type of capacitive element, that is simple and cheap to produce at the same time having small dimensions, the elements (3,4) are, according to the invention, arranged with one or several continuous openings running through them for passing the conductor through the elements and the delineation between the elements defined by means of the dielectric (5) is crossed by one or more discrete capacitive elements (6) that are electrically connected between the first and second elements.

7 Claims, 2 Drawing Sheets

INSULATOR FOR AN ELECTRICAL CONDUCTOR PROVIDED WITH AN OUTER SHIELD

BACKGROUND AND SUMMARY OF THE INVENTION

The present invention relates to an insulator for an electrical conductor provided with an outer shield in order to achieve an insulation at the shield that insulates against DC and low frequency AC signals transforming through the conductor according to the introduction to claim 1.

When electrical conductors with an external earth, for example in the form of shielding, so-called coaxial cables intended for high frequency carrier waves are connected to audio/video equipment or to equipment for telecommunication, problems of circulating earth currents frequently arise. These currents originate from differences in AC potentials between the respective points of connection of the conductors to the equipment, which leads to disturbances in the form of humming noise and disturbing signals. Such currents occur, for example, between the exchange and transmission sections of telecommunications equipment as the likelihood of differences in earth potential is great in such electrical equipment as they are located at a large distance from one another.

To avoid such said problems, it is known to provide the conductor with an insulation that blocks DC signals and low frequency AC signals but that allows the passage of more highs frequency AC signals, which in the majority of cases means signals with frequencies that exceed 50 Hz. Such insulated conductors are commonly provided with an interruption that has a capacitive junction so that DC signals and low frequency AC signals cannot pass, whereby the point at which the capacitive connection is arranged is commonly accommodated in a metallic housing that is similarly connected to earth to prevent surrounding electromagnetic radiation from affecting the signal that is led through the conductor and, conversely, to prevent the signal being transferred in the conductor from affecting nearby equipment.

Despite a number of the insulators so far known forming excellent connections for transferring high frequency signals,.and having fully satisfactory insulation against DC and low frequency signals, there is a need to both reduce the costs of manufacturing and the size of these. One reason that contributes to why known insulators have such -bulky dimensions is that the capacitive element itself constitutes a significant portion of the total dimension of the insulator. This is mainly due to the electrical functions of the capacitive element and its general construction in which the ability to accommodate electrical charges, the so-called capacitance, is proportional to the outer surface of the electrodes and the dielectric constant of the sandwich. Insulators known to date that use standard types of capacitive element, such as condensers of the monolithic ceramic type, are mounted on a pattern card, which has the disadvantage that the insulator becomes much too bulky to be useful in practice. Compare, for example, the earthing insulator known from U.S. Pat. No. 4,987,391 (Kusiak, Jr.). To reduce the outer dimensions of the insulator, it is known to use capacitive elements that have been designed to suit the body of the insulator and its function. For example, an insulator that uses specially formed capacitive elements arranged following one another in. a row and where each one has a ring-like shape with a hole in the center arranged so that the individual electrical conductors that are arranged in the coaxial cable can pass through the insulator body is known from U.S. Pat. No. 4,559,506 (Capek). Despite this type of insulator having succeeded in reducing the outer dimensions, it is far too costly to manufacture due to the specially formed capacitive elements that have to be used with it.

One main objective of the present invention is thus to achieve an insulator of the type described in the introduction that uses a standard type of capacitive element, that is simple and cheap to produce at the same time as it only has small dimensions. A second objective of the present invention is to achieve an insulator that is shielded against electromagnetic radiation.

These objectives are achieved in the insulator according to the invention having the features stated in the claims.

BRIEF DESCRIPTION OF THE DRAWINGS

Other features and advantages of the invention are evident from the other claims and the following description of one embodiment with reference to the enclosed drawings, where

DESCRIPTION OF THE PREFERRED EMBODIMENTS

Figure 1:
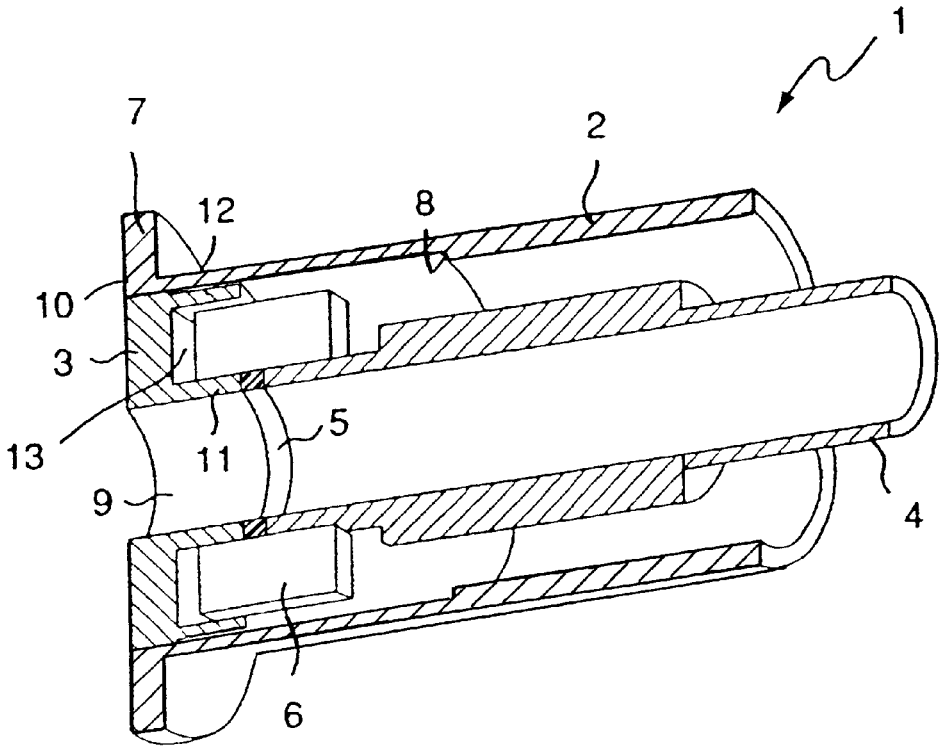
FIG. 1 shows a perspective view of an insulator according to the invention.

FIG. 1 shows in perspective an insulator generally designated with reference number 1 that has a body comprising an electrically conducting outer case 2 With a stepped design which accommodates two elements of electrically conducting material located following one another in the form of a shorter ring-shaped end piece or a first element 3 and a longer tube-shaped part or a second element 4 whose one end piece partially extends out from one end of the casing 2 when mounted in position. The ring-shaped end piece 3 and the tube-shaped part 4 are located coaxially on a common axis and positioned at a distance from one another that is defined by the width of a electrically insulating ring-shaped body or a dielectric 5 that is provided with a hole and that is located between the two. A number of discrete capacitive elements 6 extend over the insulating part that is defined by the said ring-shaped insulating body 5. These elements are oriented parallel with the direction of the axis and electrically connected at their ends with the closely located outer coaxial cylindrical surfaces of the ring-shaped end piece 3 and the tube-shaped part 4 respectively. The connecting surfaces of the ring-shaped end piece 3 and the respective tube-shaped part 4 are circular and lined up with one another, which provides the advantage that it is possible to use a standard type of capacitive element. whereby these, just like spokes, are identical and located at equal distances along the circumference of the closely located end pieces of the ring-shaped end piece 3 and the tube-shaped part 4 respectively. In this manner, an insulator body that is simple and practical to manufacture can be provided with the large numbers of discrete, parallel connected capacitive elements 6 that are needed for it to acquire the necessary resulting capacitance while still giving the insulator body the desired small outer dimensions.

Figure 2:
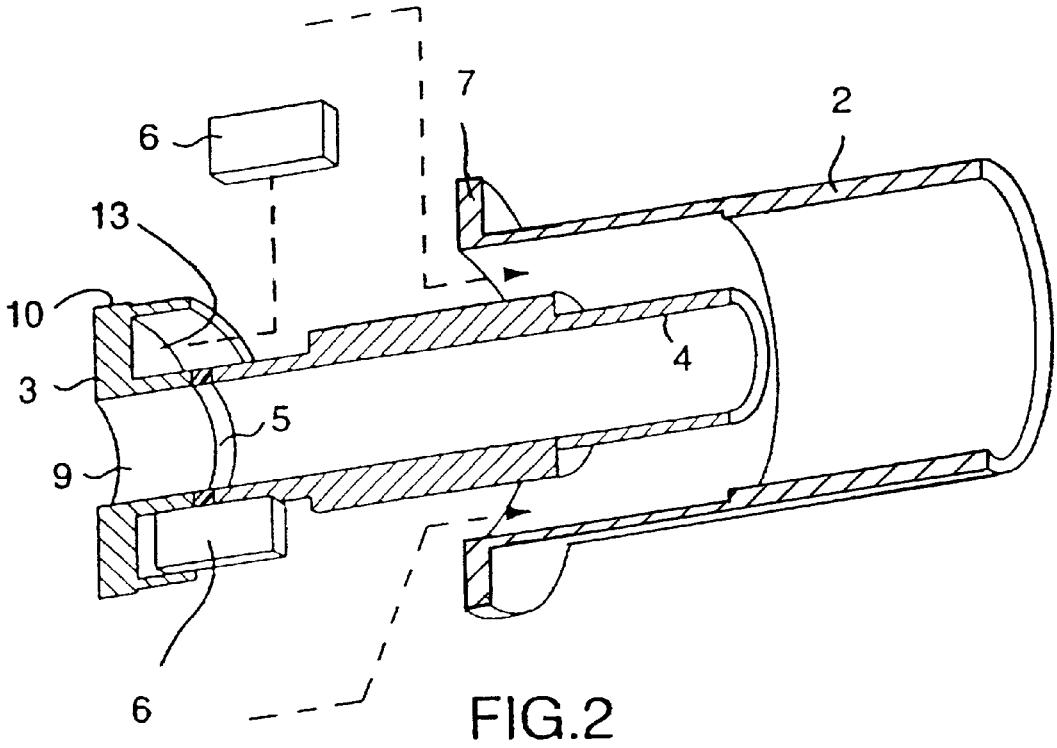
FIG. 2 shows a perspective view with parts of the insulator separated from one another.
Figure 3:
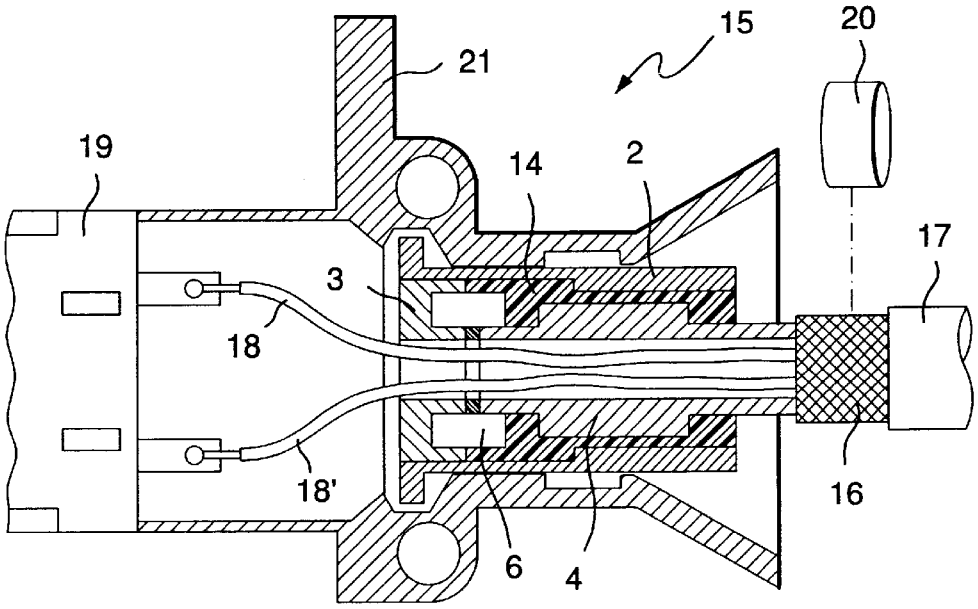
FIG. 3 shows a longitudinal cross-section of the insulator according to FIG. 1 accommodated in one shell-shaped half of a connecting mechanism separated along its length and FIG. 4 shows a perspective view of separated parts of an insulator according to the invention in a somewhat modified embodiment and accommodated in a connecting mechanism that can be separated into parts.
Figure 4:
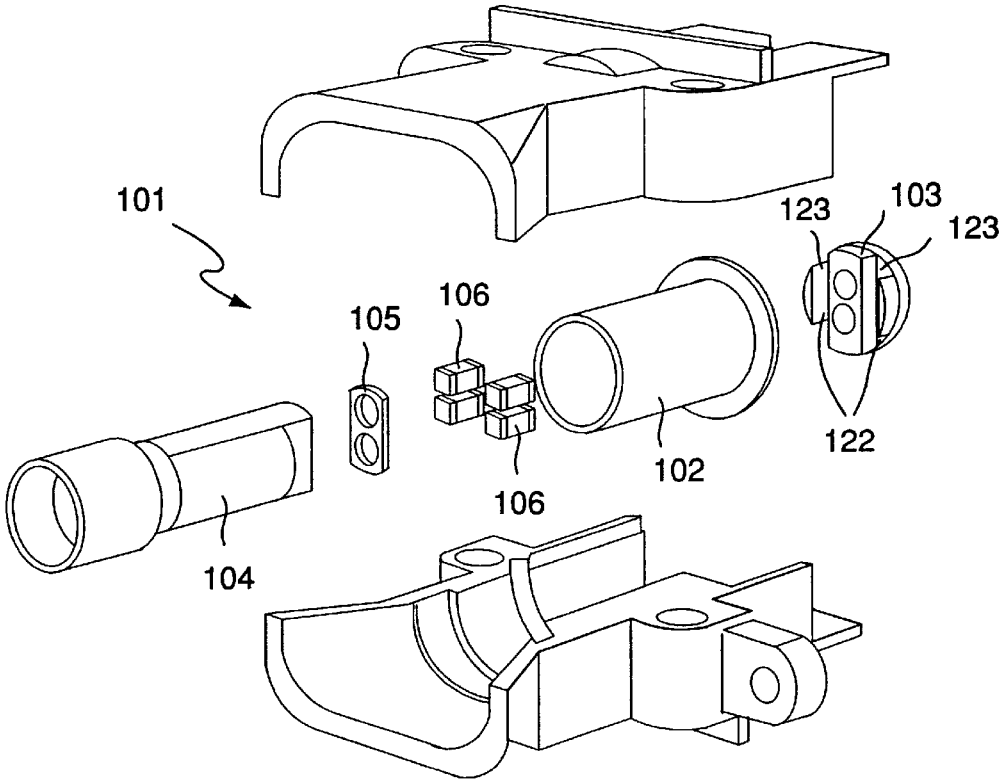

As should be evident if FIGS. 1 and 2 are studied more closely, the outer casing 2 has been given a circular cylindrical form and at one end has been provided with a radially extending section 7 to form a flange. This flange-shaped section 7 is intended for mounting by being fitted into a respective radial groove-shaped section formed in the opposite shell-shaped halves that form a contact mechanism that can be separated in the longitudinal direction, as is shown in FIGS. 3 and 4.

The outer casing 2 is ring-shaped on the inside and provided with two different inner diameters that in the transition area between them form a stepped inside surface with a ring-shaped axial plane 8 facing towards the ring-shaped end piece 3. The ring-shaped end piece 3 has axially extending ring-shaped flanges 11, 12 connecting with the hole or opening 9 located in its middle and its outer peripheral edge section 10 respectively, of which one flange section 11 forms part of the half wall and the other flange section 12 primarily forms the radial outer case surface of the ring-shaped end section 3. A circular groove like space or recesses 13 is delineated between the said axially extending flange sections 11, 12 into which space the capacitive elements fit and, when seen in the assembled position, are partially accommodated. The outer surface of the axial flange sections 12, i.e. that primarily forms the radial outer case surface of the ring-shaped end section 3, has an outer diameter that is somewhat less than the inside diameter of the ring-shaped inner casing. In addition to having the task of forming a support for the surface mounting of the capacitive elements 6 the end section also has the task of protecting the capacitive elements 6 from knocks and bumps and guiding when the ring-shaped end section 3 is pushed into the casing 2 during assembly.

As is evident from a closer study of FIGS. 1 and 2. the ring-shaped end section 3 is provided with a collar 10 running around its circumference and extending radially outwards from its circular outer main surface. This collar 10 is flat radially and has a diameter chosen with regard to the inner diameter of the casing 2 so that end section 3 can be pressed into the ring-shaped inner space of the casing 2 so that the said parts are actively held together and come into electrical contact with one another.

The production steps for manufacturing the insulator body 1 according to the invention are shown and described with reference to FIG. 2. In the first production step, the shorter ring-shaped end piece 3, the longer tube-shaped part 4 and the electrically insulating ring-shaped body 5 are joined together by, for example, gluing to form a unit where these parts are coaxially and continuously positioned after one another along a common axis as shown in FIG. 1. In a second production step, the discrete capacitive elements 6 are mounted to the unit formed so that when they are accommodated in the ring-shaped groove 13 and extend over the dielectric section that is delineated by the ring-shaped body 5, they are identically and equally positioned along the circumference of closely located end pieces of the ring-shaped end piece 3 and the tube-shaped part 4 respectively. Following this, the said capacitive elements 6 are electrically connected with the closely located outer coaxial cylindrical surfaces of the ring-shaped end piece 3 and the tube-shaped part 4 respectively. This assembly and electrical connection are preferably accomplished by means of known surface mounting technology.

As is shown in the figure by the dashed lines, the unit formed is inserted into the said casing 2 in a third step so that it remains accommodated in the casing 2. In a subsequent fourth step, an electrically insulating resin 14 or similar insulating formable material that then hardens in introduced into the space delineated by casing 2 and the material fills out the ring-shaped space that is primarily delineated between the ring-shaped part 3, the tube-shaped part 4 and the outer casing 2. In fact, the resin material can be introduced into the casing 2 in a certain excess since possible excess can be allowed to exit from the open end of the insulator body 1.

By interaction with the stepped transitions of diameter and the relatively rough surfaces that are arranged in the inside of casing 2 as well as the diameter transitions and the irregular shape of the formed unit in general, the hardened forming material will thus build a moulded, fixed form between the parts that make up the unit and the casing 2. In this manner, the outer forces and mechanical stresses that the insulator body 1 can be subjected to during normal use cannot be transferred to the sensitive capacitive elements 6, but are primarily taken up by the enclosing and insulating forming material.

FIG. 3 shows the insulator body 1 according to the invention accommodated in one half of a separable connecting mechanism generally designated 15. A space for accommodating the insulator body 1 is delineated between the halves, whereby the insulator body, at least in its axial direction, is fixed in said connection mechanism 15 and, as should be realised, is thus in electrical connection with this due to the interaction between the radially extending flange section 7 and grooves arranged in each half of the connecting mechanism 15. A conventional twin cable 17 provided with an outer shield 16 is connected to the longer tube-shaped part 4 that extends from the end of the insulating body 1. Two electrical conductors 18, 18' extending from the twin cable 17 are accommodated in the elongated channel that runs through the centre of the insulating body 1 and that extends through the ring-shaped end piece 3, the tube-shaped part 4 and the electrically insulating ring-shaped body 5 that is located between the two. At their ends, these conductors 18, 18' are electrically connected by respective connecting points to a commonly occurring matrix type of contact 19 arranged in a connecting mechanism. The earthing braid or screen 16 of the twin cable is firmly attached via a clamp ring 20 or similar with one end of the longer tube-shaped part 4 and is in electrical contact with the outer casing 2 across the capacitive elements 6 as well as via the ring-shaped part 3. As mentioned above, the said outer casing 2 is accommodated in the connecting mechanism 15 and is thus also positioned at at least some point in electrical contact with the electrically conducting outer casing 21 of the connecting mechanism 15, which is in turn connected to an external earth, for example by firmly screwing at the outer casing to a cabinet of an apparatus or similar. As such, it should be realised that in this way the connection as a whole is shielded against electromagnetic radiation.

FIG. 4 shows a perspective view with drawn apart sections of an alternative embodiment according to the invention accommodated in a separable connecting mechanism and particularly useful when insulating so-called double coaxial cables having two centre conductors separated from one another with associated shields. The reference numbers used in this figure have been increased by 100 in comparison with the previous figures to clarify that it deals with similar details that have essentially the same functions as the details already described. As described above, the insulator generally designated by reference number 101 includes a body comprising an outer, electrically conducting casing 102 which accommodates two elements of electrically conducting material located coaxially following one another and comprising an end piece 103 and a sleeve coupling 104 as well as a flat-shaped electrically insulating part 105 located between the two. Two holes that are separated from one another and in which the respective conductors of the double coaxial cables are intended to be accommodated extend through each part in parallel with the centre axis of the said parts. One end of end section 103 is provided with three axially extending parts 122 that together delineate two parallel grooves 123 running across the direction of the axis and located on either side of the centre axis of the end part. The centre section of these axially extending sections is significantly larger than the others and its axially extending end surface has a shape that is in principle equivalent to the axial end surfaces of the flat-shaped section 105 that face away from one another as well as to the meeting axial end surface of connecting sleeve 104. On either side of the centre axis of the insulator, two discrete capacitive elements 106 extend across the insulating section that is defined by the flat-shaped section 105. These capacitive elements 106 are oriented parallel with the direction of the axis and are electrically connected at their ends with the closely located surfaces of the end part 103 and the connecting sleeve 104 respectively. The respective shielding braids of the double coaxial cable are intended to both be connected together at the larger diameter end section of the connecting sleeve 104 by means of a clamp ring or similar in the manner shown in FIG. 3.

The present invention is not limited to that described above and shown in the drawings, but can be changed and modified in a variety of different ways within the scope of the concept of the invention stated in the following claims.

What is claimed is:

1. Insulator for an electrical conductor provided with an outer shield, in order to achieve an insulation at the shield that insulates against DC and low frequency AC signals transforming through the conductor and that includes a first and a second element (3, 4) formed from electrically conducting material that by means of a dielectric (5) are electrically insulated and delineated from one another and that are intended to be connected between an interruption at the shield or between the shield and an external earth connection characterised in that the elements (3, 4) are arranged with one or several continuous openings running through them for passing the conductor through the elements and that the delineation between the elements defined by means of the dielectric (5) is crossed by one or more discrete capacitive elements (6) that are electrically connected between the first and second elements.

2. Insulator according to claim 1 characterised in that each opening extends axially through the first and second elements (3, 4) and that the discrete capacitive elements (6) are distributed along the outer peripheries of the first and the second elements that surround the said openings.

3. Insulator according to claim 1 characterised in that the first and second elements (3, 4), at least in the areas of the dielectric (5) defining the electric delineation between the elements, have a circular outer periphery and that the discrete capacitive elements (6) are equally distributed along this circular outer periphery.

4. Insulator according to claim 1 characterised in that it includes groove-like recesses (13) formed in any of the end sections of the first and second electrically conduction elements (3, 4) that face one another and in which groove-like recesses the discrete capacitive elements (6) are arranged to be accommodated.

5. Insulator according to claim 1 characterized in that the first and second elements are wholly or partially surrounded by an outer casing (2) so that a space is delineated between the respective outsides of the first and second elements (3, 4) and the inside of the casing; and the first element, the second element and the outer casing have anchoring areas that interact with an insulating material (14) that fills the space and surrounds the capacitive elements to fix the first and second elements and the outer casing to one another.

6. Insulator according to claim 5, characterized in that the outer casing (2) includes an electrically conducting material that is electrically connected with one of the first and second elements (3, 4).

7. Insulator according to claim 6 characterised in that the insulator forms part of a connecting mechanism (15) that has a casing formed from electrically conducting material, whereby the insulator is placed in an accommodating space arranged in the connecting mechanism and where the insulator is located in electrical contact with the casing of the connecting mechanism.

* * * * *